US007203993B2

(12) United States Patent
Tondra et al.

(10) Patent No.: US 7,203,993 B2
(45) Date of Patent: Apr. 17, 2007

(54) SUCTION NOZZLE HEIGHT ADJUSTMENT AND CONTROL ARRANGEMENT

(75) Inventors: Aaron P. Tondra, North Canton, OH (US); Evan A. Gordon, Canton, OH (US)

(73) Assignee: The Hoover Company, North Canton, OH (US)

( * ) Notice: Subject to any disclaimer, the term of this patent is extended or adjusted under 35 U.S.C. 154(b) by 672 days.

(21) Appl. No.: 10/746,057

(22) Filed: Dec. 23, 2003

(65) Prior Publication Data

US 2006/0130270 A1 Jun. 22, 2006

(51) Int. Cl.
*A47L 5/34* (2006.01)

(52) U.S. Cl. ..... 15/362; 15/354

(58) Field of Classification Search ..... 15/319, 15/354–356, 361, 362, 49.1, 50.1, 52.1, 98
See application file for complete search history.

(56) References Cited

U.S. PATENT DOCUMENTS 4,754,520 A * 7/1988 Steadings et al. ..... 15/319
5,056,175 A * 10/1991 Stein et al. ..... 15/49.1
6,481,515 B1 * 11/2002 Kirkpatrick et al. ..... 180/65.1
2006/0000052 A1 * 1/2006 Budd ..... 15/361

* cited by examiner

*Primary Examiner*—Terrence R. Till
(74) *Attorney, Agent, or Firm*—A. Burgess Lowe; Michael J. Corrigan

(57) ABSTRACT

A floor care appliance is provided with a microprocessor based control arrangement. The microprocessor adjust the height of the suction nozzle through a motorized suction nozzle height gear and cam arrangement. The microprocessor is programmed to turn the current off to either of the motor-fan assembly or the agitator drive motor when the current consumed by either exceeds a predetermined amount based upon the nozzle height. The height of the suction nozzle is selected by one or more switches located on the appliance handle. A separate switch is provided to select bare floor mode and the microprocessor is programmed to store the height of the suction nozzle prior to bare floor mode being selected. By pressing a the bare floor mode button again or the use of a sensor the suction nozzle is returned to the stored position when the suction nozzle is returned to the carpeted surface.

20 Claims, 4 Drawing Sheets

SUCTION NOZZLE HEIGHT ADJUSTMENT AND CONTROL ARRANGEMENT

BACKGROUND OF THE INVENTION

1. Field of the Invention

This invention relates to floor care, and more specifically, to a floor care appliance having an automatic nozzle height adjustment arrangement.

2. Summary of the Prior Art

Floor care appliances are well known in the art. Typical floor care appliances include upright vacuum cleaners, canister vacuum cleaners, hard floor cleaners, and extractors. More recently floor care appliances have been provided with increasingly sophisticated microprocessor based control systems for controlling one or more features including, for example, a suction motor, agitator motor, bag full indicators, and the like. Typically, such microprocessors are permanently pre-programmed at the factory with instructions for controlling one or more of the operational features. The present invention utilizes a microprocessor to control the one or more of the operational features such as those just described, and more specifically, the height of the suction nozzle by controlling an independent nozzle height adjustment motor. The microprocessor is programmed to adjust the height of the suction nozzle with switches on the cleaner handle and also adjust the current to the suction motor and the agitator drive motor if so equipped.

Accordingly, it is an object of the invention to provide a floor care appliance having a microprocessor based control system for controlling one or more operational feature.

It is a further object of this invention to provide a floor care appliance having a microprocessor based control system that can be for controlling one or more operational features including the height of the suction nozzle.

SUMMARY OF THE INVENTION

In the preferred embodiment of the invention, a floor care appliance having a programmable microprocessor is provided wherein the microprocessor is programmed to store operational parameters of the appliance as well as real time performance data. The microprocessor is also pre-programmed to control the height of the suction nozzle based upon inputs from the user and the type of floor surface the suction nozzle is operated upon. The input from the user comes from one or more switches located on the cleaner appliance handle. The subject microprocessor is part of an improved power management system for controlling the total amount of current provided to at least a first and a second load device of an appliance. The amount of current provided to at least a first and a second load device of an appliance is based upon the input from the switches and the type of floor surface the suction nozzle is operated upon.

The power management system is comprised of the microprocessor, an alternating current voltage source, a voltage regulating circuit, a clamping circuit, a clamping circuit, at least two load devices, and a MOC and a triac for each of the at least two load devices. The clamping circuit outputs a fixed voltage during the portion of the ac cycle which is greater than or less than zero and provides a zero or negligible voltage while the ac cycle is at zero voltage. The fixed voltage and the zero or negligible voltage are input to a microprocessor. The microprocessor utilizes these inputs to control the amount of time the current is turned on to each of the at least first and second load devices. The current is turned on to each of the at least first and second load devices by an output from the microprocessor provided to the associated MOC which in turn controls the associated triac for turning the current on to the associated load. One of the at least first and second loads has a sensing circuit which monitors the current drawn by the load. A surge or rise in the current drawn will cause an output from the sensing circuit which is input to the microprocessor.

The microprocessor will adjust according to pre-programmed instructions the amount of time the current is turned on to each of the at least first and second loads so that the total current drawn by all of the at least first and second loads does not exceed a pre-determined value. This requires that the microprocessor reduce the current provided to the at least second load to account for the increased amount of current used by the first load In one embodiment of the power management system, the at least first and second loads are a motor-fan assembly and an agitator drive motor. The pre-determined level or total current that may be drawn by both motors is 12 amps with the agitator drive motor initially programmed to draw 2 amps. This means that the motor-fan assembly can initially draw 10 amps. An increase in the load placed on the agitator drive motor will cause the amount of current drawn by the agitator drive motor to exceed 2 amps. Necessarily, the microprocessor will adjust the current provided to the motor-fan assembly to less than ten amps.

BRIEF DESCRIPTION OF THE DRAWINGS

Reference may now be had to the accompanying drawings for a better understanding of the invention, both as to its organization and function, with the illustration being only exemplary and in which.

DETAILED DESCRIPTION OF THE INVENTION

Figure 1:
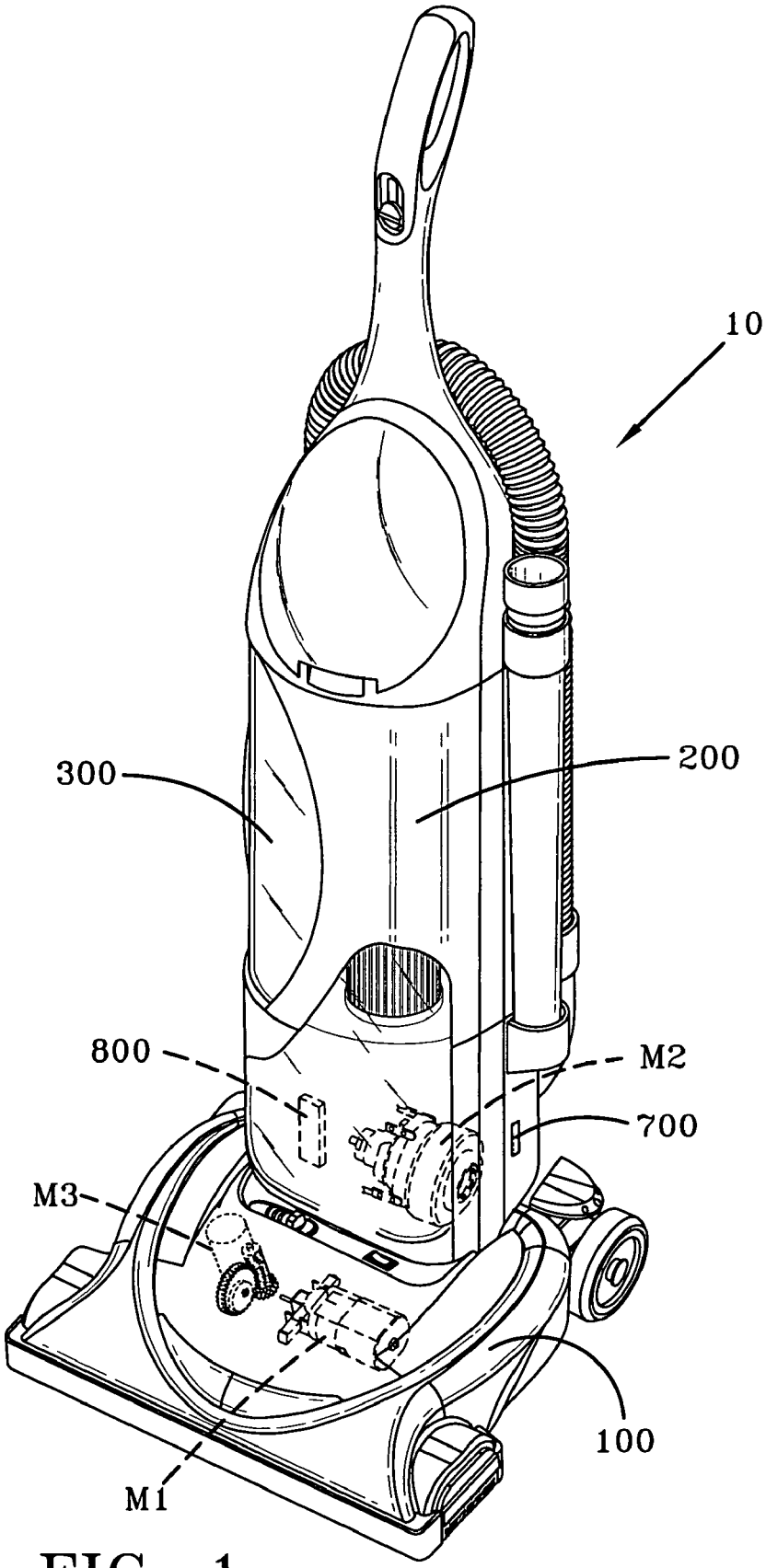
FIG. 1 is a perspective view of a floor care appliance having an automatic nozzle height adjustment arrangement, according to the preferred embodiment of the present invention.
Figure 2:
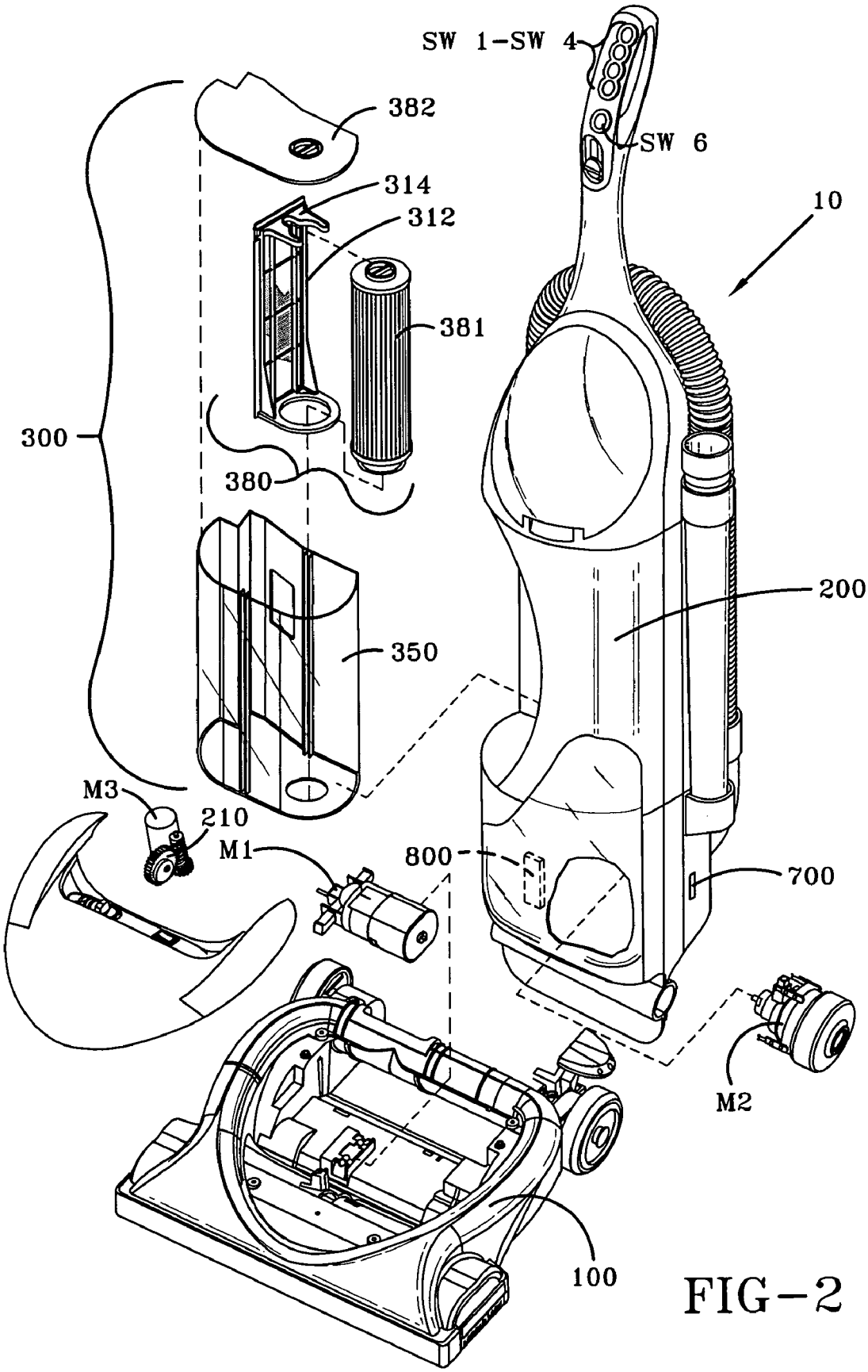
FIG. 2 is an exploded view of a floor care appliance having a having an automatic nozzle height adjustment arrangement, according to the preferred embodiment of the present invention.

Referring now to FIGS. 1 and 2, shown is a floor care appliance 10 which in the preferred embodiment is an upright vacuum cleaner having a microprocessor based control system for controlling one or more operational features including the height of the suction nozzle or foot 100. In alternate embodiments of the invention, floor care appliance 10 could be any type of floor care cleaner such as a canister cleaner, stick cleaner, carpet cleaner, or a bare floor cleaner. Upright vacuum cleaner 10 includes an upper housing assembly 200 pivotally connected to foot 100. Foot 100 is similar to those known in the art and includes a nozzle opening (not shown) for receiving a stream of dirt-laden air and an agitator (not shown) for agitating and loosening dust and debris from a floor surface when upright vacuum cleaner 10 is in the floor care mode. Foot 100 further includes a pair of front wheels (not shown) rotatably mounted on a wheel carriage (not shown), and a pair of rear wheels.

Located in foot 100 or upper housing 200 is a motor-fan assembly M2 which creates the suction necessary to remove the loosened dust and debris from the floor surface. The motor-fan assembly M2 fluidly connects to foot or suction nozzle 100 by a dirt duct (not shown). The upper housing assembly 200 houses a particle filtration and collecting system 300 for receiving and filtering the dirt-laden air stream which is created by the motor-fan assembly M2. The particle filtration and collecting system 300 may be interposed in the dirt laden air stream between the suction nozzle 100 and the motor-fan assembly M2 as in an "indirect air" system seen in FIG. 1 or the motor-fan assembly M2 may be interposed between the suction nozzle 100 and the particle filtration and collecting system 300 as in a "direct air" system. An independent electric agitator drive motor M1 is provided for providing rotary power for at least one rotary agitator (not shown) and an independent suction nozzle height adjustment motor M3 is provided for adjusting the height of the suction nozzle 100 relative to the floor surface. Motor-fan assembly M2, agitator drive motor M1, and suction nozzle height adjustment motor M3 are controlled by a suction nozzle height and power management system 800 located in the upper housing 200. Although power management system 800 may be located anywhere on the floor care appliance 10, including foot 100, it desirable to have power management system 800 located in a moving air stream such as the exhaust for motor-fan assembly M2 for cooling purposes. Power management system 800 is shown in FIG. 1 in the form of a snap-in module but may be constructed in numerous other ways. A detailed description of the composition and operation of power management system 800 is given below.

Referring now to FIG. 2, shown is an exploded view of a floor care appliance 10 with a preferred embodiment dirt collecting system 300. Dirt collecting system 300 generally includes a translucent dirt cup 350, a filter assembly 380 removably mounted within the dirt cup 350 and a dirt cup lid 382 which encloses the dirt cup 350. Filter assembly 380 generally includes an apertured wall 312, a filter support 314 extending from the apertured wall 312 and a primary filter member 381 which removably mounts on the filter support 314. The holes provide for fluid communication between the first dirt collecting chamber 316 and the second dirt collecting chamber 318. The apertured wall 312 functions as a coarse particle separator or pre-filter and could include any number of holes having various shapes (circular, square, elliptical, etc.), sizes and angles. To maximize airflow through the holes while still preventing large debris from passing there through, it is desirable to form the holes as large as 0.0036 square inches and as small as a 600 mesh screen. In the present embodiment, the holes 312 are circular with a hole diameter of approximately 0.030 inches. Further, the apertured wall should be formed with enough total opening area to maintain airflow through the dirt cup. It is desirable to form apertured wall 312 with a total opening area of between approximately 2.5 square inches to approximately 4 square inches. Complete details of the dirt collecting system 300 can be found in Hoover Case 2521, application Ser. No. 09/519,106, owned by a common assignee and incorporated be reference fully herein.

Several switches $SW_1$ through $SW_4$ and $SW_6$ are located at the one end of the cleaner handle. Some of the switches $SW_1$ through $SW_4$ are used to adjust the height of the suction nozzle 100 where each switch $SW_1$ through $SW_4$ corresponds to a particular suction nozzle height 100 from the lowest carpet setting to the maximum height position. Such settings could include plush, multilevel, shag, and gropoint. The switches $SW_1$ through $SW_4$ are operatively connected to the microprocessor 810 which is part of the power management system 800. The microprocessor 810 is also operatively connected to an independent electric motor M3 which is used to raise and lower the suction nozzle height 100 according to which of the switches $SW_1$ to $SW_4$ or $SW_6$ are selected. The microprocessor 810 controls the at least first and second loads which in the preferred embodiment are a motor-fan assembly M2 and an agitator drive motor M1. The microprocessor 810 adjusts the current supplied to the motor-fan assembly M2 and the agitator drive motor M1 based upon the switch selected such that the pre-determined level or total current that may be drawn by both motors is 12 amps. The microprocessor 810 also adjusts the current supplied to the motor-fan assembly M2 and the agitator drive motor M1 based upon the current being consumed by the agitator drive motor M1 as sensed by a current sensing circuit 870 such that the pre-determined level or total current that may be drawn by both motors is 12 amps.

Figure 4:
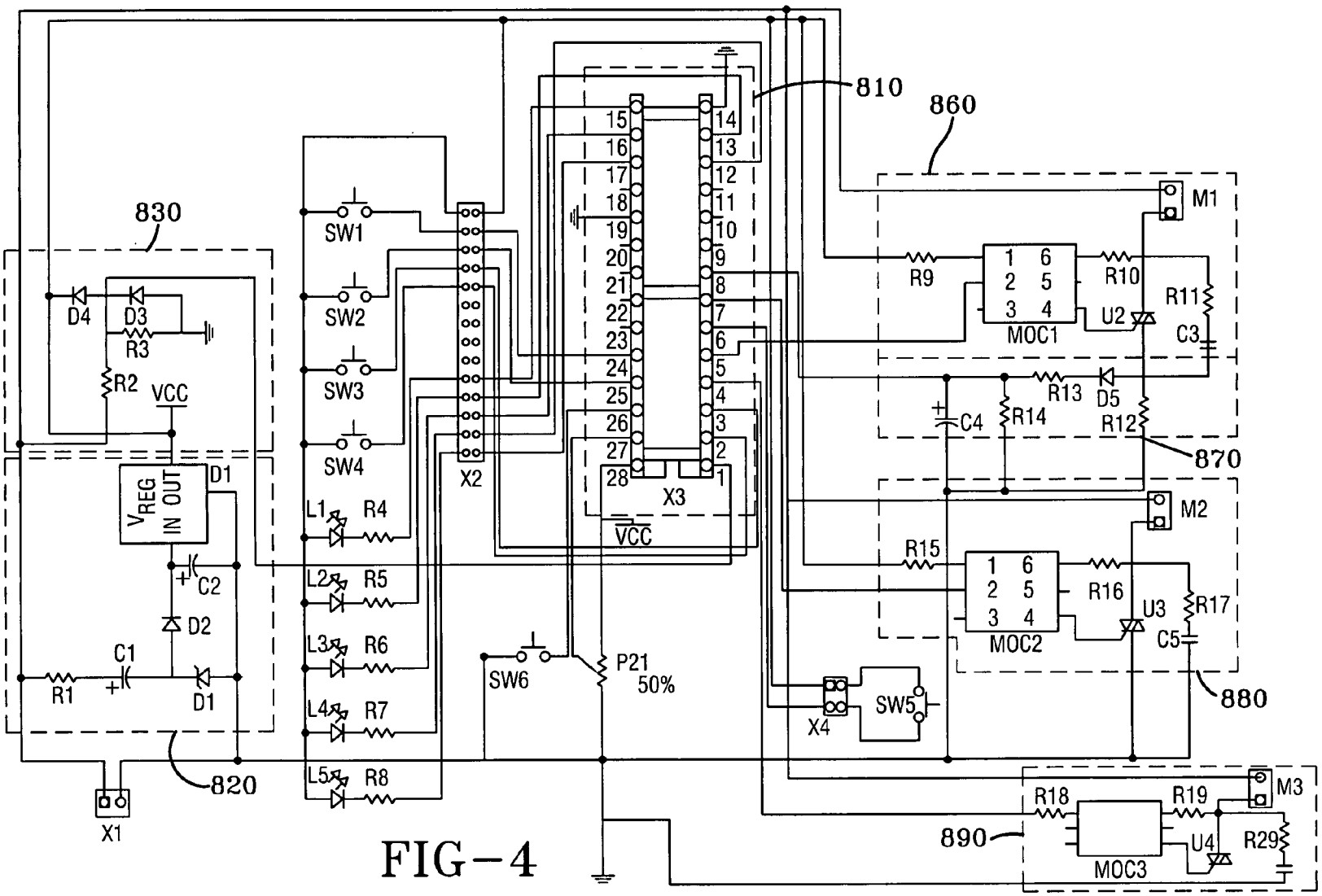
FIG. 4 is an electrical schematic of a microprocessor based automatic suction nozzle height adjustment arrangement, according to the preferred embodiment of the present invention.

Another switch $SW_6$ may also be located on the upper end of the cleaner handle so that the user may adjust the suction nozzle 100 to bare floor mode by simply pressing the switch $SW_6$. The microprocessor 810 will adust the suction nozzle 100 to the bare floor position while simultaneously adjusting the current to the motor-fan assembly M2 and the agitator drive motor M1. The microprocessor 810 can be programmed so that the position of the suction nozzle 100 before the switch $SW_6$ for bare floor mode is pushed is stored. With this feature, the suction nozzle 100 can be restored to its previous position by a subsequent pressing of the switch $SW_6$ or moving the suction nozzle 100 from a bare floor surface. The latter means for restoring the suction nozzle 100 to the previous position would necessarily require a sensor (not shown) operatively connected to the microprocessor 810 for detecting the floor surface. The position of the suction nozzle 100 relative to the floor surface can be sensed by the microprocessor 810 operatively connected to a potentiometer P21 (FIG. 4). The potentiometer P21 (FIG. 4) inputs the position and height of the suction nozzle 100 as a voltage to the microprocessor 810. A height indicator may also be positioned on the surface of the suction nozzle 100 to give the user indicia of the suction nozzle height 100. This can be a mechanical type, luminescent, or other type of indicia.

Figure 3:
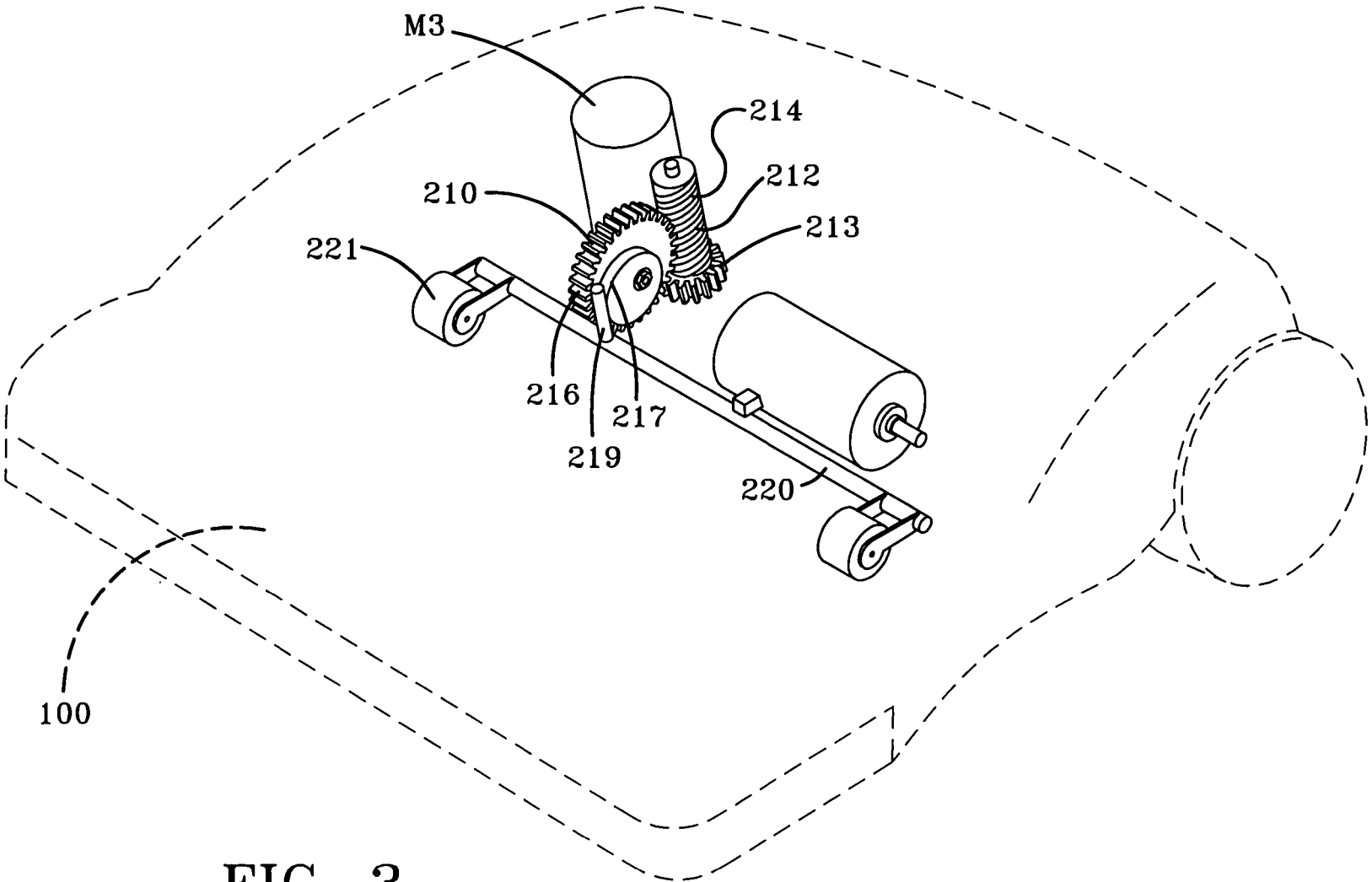
FIG. 3 is a perspective view of a suction nozzle with the hood removed showing the suction nozzle height adjustment motor and gearing arrangement, according to the preferred embodiment of the present invention.

Referring now to FIG. 3, shown is an outline of a suction nozzle 100 showing the suction nozzle height adjustment motor M3 and suction nozzle height adjustment arrangement 210. The suction nozzle height adjustment motor M3 raises and lowers the suction nozzle 100 when energized by power management system 800 and microprocessor 810. Suction nozzle height adjustment motor M3 is rotatably coupled to a first gear 212 having a radial gear portion 213 and a worm gear portion 213. The worm gear portion rotates a radial gear 216 that has a cam portion 217 on the one side. The cam portion 217 urges a lever 219 which is perpendicularly connected to and rotates a rod 220 which urges a set of wheels 221 toward the floor surface to raise the suction nozzle 100 or releases the pressure on rod 220 and wheels 221 to lower suction nozzle 100.

Referring now to FIG. 4, shown is an electrical schematic of the preferred embodiment of the suction nozzle height and power management system 800. Power management system 800 is comprised of a microprocessor 810, an alternating current voltage source X1, a voltage regulating circuit 820, a clamping or "zero cross detecting circuit" 830, three load devices M1, M2 and M3, at least a first load driver circuit 860 and a second load driver circuit 880, a sensing circuit 870 for sensing the current drawn by one of the at least two load devices M1 and M2, a plurality of switches $SW_1$ to $SW_4$ and $SW_6$ for controlling various floor care appliance 10 features, and a plurality of light emitting diodes $Ld_1$ to $Ld_n$ whereon one light emitting diode is associated with each of said plurality of switches $SW_1$ to $SW_4$. The clamping or "zero cross" circuit 830 outputs a fixed voltage during the portion of the ac cycle which is greater than or less than zero and outputs a zero or negligible voltage while the ac cycle is crossing the zero voltage threshold. Thus, clamping circuit 830 acts as a "zero cross detector" at any given time as either the fixed voltage or the zero or negligible voltage are input to a microprocessor 810 so the microprocessor 810 knows when the ac cycle is crossing the "zero voltage threshold". In the preferred embodiment of the invention, the fixed voltage is 5.7 volts and the zero or negligible voltage is −0.7 volts.

The microprocessor 810 is programmed to utilize these inputs to control the amount of time the current is turned on to each of the at least first and second load devices M1 and M2. The microprocessor 810 essentially has timers for each of the at least two load devices M1 and M2 that start timing the amount of time the current is turned on to each the at least two load devices M1 and M2 each time the ac current crosses past the "zero voltage threshold". The current is turned on to each of the at least first and second load devices M1 and M2 by an output from the microprocessor 810 provided to an associated triac driver device MOC1 and MOC2 known as a "MOC" which in turn controls an associated triac U1 and U2 which when activated turns the current on to an associated load device M1 and M2. A triac drive device or "MOC" model no. MOC3010-M made by Fairchild Semiconductor of South Portland, Me. has been found to be suitable for this purpose.

One of the at least first and second loads M1 and M2 has a sensing circuit 870 associated with it which monitors the current drawn by the load device M1 and M2. In the preferred embodiment, the current sensing circuit 870 is associated with M1. A surge or rise in the current drawn by the load device M1 will cause an output from the sensing circuit 870 which is input to the microprocessor 810. The microprocessor 810 will adjust according to pre-programmed instructions the amount of time the current is turned on to each of the at least first and second loads M1 and M2 so that the total current drawn by all of the at least first and second loads M1 and M2 does not exceed a pre-determined value. This requires that the microprocessor 810 reduce the current provided to the at least second load device M2 to account for the increased amount of current used by the first load device M1. When the increased load on the second load device M2 is reduced, the microprocessor's 810 programming will reduce the amount of time that current is turned on to the first load M1 while increasing the amount of time the current is turned on to the second load M2 such that the total current used by both the first and second load M1 and M2 does not exceed the predetermined value.

In one embodiment of the power management system 800, the at least first and second loads M1 and M2 are a motor-fan assembly M2 and an agitator drive motor M1. The pre-determined level or total current that may be drawn by both motors is 12 amps with the agitator drive motor M1 initially programmed to draw 2 amps. This means that the motor-fan assembly M2 can initially draw 10 amps. An increase in the load placed on the agitator drive motor M1 will cause the amount of current drawn by the agitator drive motor M1 to exceed 2 amps. Necessarily, the microprocessor 801 will adjust the current provided to the motor-fan assembly M2 to less than ten amps. Note that this is only one possible configuration as additional loads $M_3$ through $M_n$ may be added and the microprocessor 810 can be programmed to adjust the current to each of the loads $M_1$ through $M_n$ as the current increases in one of the $M_1$ through $M_n$ loads so that the sum total current used by all loads $M_1$ through $M_n$ does not exceed a predetermined value. With the use of switches $SW_1$ to $SW_4$ to turn various features on and off, the microprocessor 810 can control the current to each of the loads $M_1$ through $M_n$ that remain on so that the total current drawn by the loads $M_1$ through $M_n$ does not exceed a pre-determined level. The entire power management system 800 could be embedded on a plug in module which simplifies assembly of floor care appliance 10 and replacement and/or upgrade of power management assembly 800.

Power is supplied to power management system 800 by an ac voltage source 805 which is typically 120 vac at 60 hz. The 120 vac line voltage is reduced through a resistor R1 and capacitor C1 and then the Zenerdiode D1 which clamps the voltage to around 30 vac. The 30 vac voltage is half-wave rectified to direct current through the diode D2 and smoothed through a capacitor C2. The smoothed direct current is fed into a voltage regulator U1 that outputs a regulated 5 vdc voltage from the 10–35 vdc input. This 5 vdc power is then supplied to the microprocessor and the other low voltage devices and controls discussed above.

The 120 vac voltage source 805 also has its voltage dropped through the resistive divider R2 and R3. On the positive half of the AC wave, the upper diode D4 conducts and the output signal is clamped to 5.7 vdc. On the negative half of the AC wave, the lower diode D3 conducts and the output signal is clamped to 0 vdc. This square wave pulse train coincides with the zero crossing of the main 120 vac line. This signal is fed into the microprocessor 810 and used to sequence the firing of motors M1 and M2 (or other load devices M3 through $M_n$) with the main ac voltage line based upon the zero crossing.

The switches $SW_1$ through $SW_4$ and $SW_6$ look for a transition from 0 vdc to 5 vdc or vice versa to recognize a valid press. Each switch $SW_1$ to $SW_4$ and $SW_8$ corresponds with a different floor mode or suction nozzle height 100. The LED's $L_1$ through $L_5$ and associated resistors R4 through R8 are used for indication of which floor mode or carpet height is currently selected.

Each of the load driver circuits 870 and 880 is comprised of a MOC 1 and MOC 2, respectively used for firing triacs U2 and U3, respectively. MOC 1 and MOC 2 are devices that are used to either block or pass a portion of the 120 vac power to load devices M1 and M2. When a valid zero cross is determined, timers internal to microprocessor 810 start timing and when the preset time is reached the input signal to MOC 1 and MOC 2 is toggled and the device will allow a portion of the 120 vac wave to pass. The preset times can range from 0 to 7 miliseconds depending on the average voltage that needs to be passed to M1 and M2. Triacs U2 and U3 are devices that switch on and off allowing current to flow to M1 and M2 based upon MOC 1 and MOC 2 and the timing signal coming through the microprocessor 810.

Current sensing circuit 870 is a low ohm power resistor that generates a voltage with respect to the current through the agitator motor M1. That low voltage AC signal is half-wave rectified through a diode, filtered and smoothed through a resistive/capacitive network. That signal is then fed into an A/D pin on the microprocessor 810 where it is used to determine the load on M1. Based upon the load on M1, decisions can be made to change the speeds of M1 and M2 based upon the surface being cleaned, stall detection, etc. The microprocessor 810 can be programmed with a current setting for each suction nozzle height 100 position to stall the agitator (not shown) when the current being consumed by the agitator drive motor M1 exceeds the particular setting.

A suction nozzle height adjustment motor circuit 890 is provided for controlling the operation of the height adjustment motor M3. Upon receiving an output from the microprocessor 810, which is based upon the user pressing switches $SW_1$ through $SW_4$ or $SW_6$, MOC 3 fires a triac U4 which controls the current to the suction nozzle height adjustment motor M3. As previously described, a potentiometer P21 is mechanically coupled to the suction nozzle height adjustment arrangement 210 which raises and lowers the suction nozzle 100 height which outputs a voltage which is input to microprocessor 810 to sense the actual position of the suction nozzle 100.

It should be clear from the foregoing that the described structure clearly meets the objects of the invention set out in the description's beginning. It should now also be obvious that many changes could be made to the disclosed structure which would still fall within its spirit and purview.

The invention claimed is:

1. A floor care appliance, comprising:

a base portion for contacting a floor surface and performing a cleaning operation thereon;

at least one electrically powered device producing work related to the cleaning operation;

a motorized gear and cam arrangement for adjusting the height of the base portion relative to the surface;

a microprocessor for controlling said at least one electrically powered device and said motorized gear and cam arrangement; and one or more switches operatively connected to said microprocessor for inputting the desired height of said base portion relative to the surface;

wherein said microprocessor is programmed to automatically adjust the height of said base portion relative to the surface based upon the input from said one or more switches and to automatically adjust the current to said at least one electrically powered device.

2. The floor care appliance of claim 1, wherein said at least one electrically powered device is a motor-fan assembly.

3. The floor care appliance of claim 1, wherein said at least one electrically powered device is a motor-fan assembly and an electric motor for a rotary agitator.

4. The floor care appliance of claim 1, wherein said microprocessor adjusts the current to said at least one electrically powered device based upon the height of said base portion such that the total current supplied to said at least one electrically powered device does not exceed a pre-determined limit.

5. The floor care appliance of claim 1, further including a sensor operatively connected to said microprocessor to sense the height of said base portion relative to said surface.

6. The floor care appliance of claim 5, wherein said sensor is a potentiometer.

7. The floor care appliance of claim 1, wherein one of said one or more switches is a bare floor switch and when said bare floor switch is depressed said microprocessor adjusts said base portion to a position which is optimum for removing dirt particles from a bare floor.

8. The floor care appliance of claim 7, wherein said microprocessor stores the position of said base portion prior to said bare floor switch being depressed.

9. The floor care appliance of claim 8, wherein said microprocessor returns said base portion to said stored position when said bare floor switch is depressed again.

10. The floor care appliance of claim 8, wherein said microprocessor returns said base portion to said stored position when said base portion is moved from over a bare floor to a carpeted surface.

11. The floor care appliance of claim 1, wherein said microprocessor is programmed to shut off the current to each of said at least one electrical devices for each position of said base portion if the current drawn by said at least one electrical device exceeds a predetermined amount.

12. A vacuum cleaner of the type having a suction nozzle, a motor-fan assembly, a dirt collecting system, and an agitator drive motor, comprising:

a motorized gear and cam arrangement for adjusting the height of the suction nozzle over a surface to be cleaned;

a microprocessor for controlling the speed of the motor-fan assembly and the agitator drive motor;

one or more switches operatively connected to said microprocessor for selecting the desired height of said suction nozzle relative to the surface;

wherein said microprocessor is programmed to automatically adjust the height of said suction nozzle relative to the surface based upon the input from said one or more switches and to automatically adjust the current to said motor-fan assembly and said agitator drive motor.

13. The vacuum cleaner of claim 12, wherein said microprocessor adjusts the current to said to said motor-fan assembly and said agitator drive motor such that the total current supplied to said motor-fan assembly and said agitator drive motor does not exceed a pre-determined limit.

14. The vacuum cleaner of claim 12, further including a sensor operatively connected to said microprocessor to sense the height of said suction nozzle relative to said surface.

15. The vacuum cleaner of claim 14, wherein said sensor is a potentiometer.

16. The vacuum cleaner of claim 12, wherein one of said one or more switches is a bare floor switch and when said bare floor switch is depressed said microprocessor adjusts said suction nozzle to a position which is optimum for removing dirt particles from a bare floor.

17. The vacuum cleaner of claim 16, wherein said microprocessor stores the position of said suction nozzle prior to said bare floor switch being depressed.

18. The vacuum cleaner of claim 17, wherein said microprocessor returns said suction nozzle to said stored position when said bare floor switch is depressed again.

19. The vacuum cleaner of claim 18, wherein said microprocessor returns said suction nozzle to said stored position when said suction nozzle is moved from over a bare floor to a carpeted surface.

20. The vacuum cleaner of claim 12, wherein said microprocessor is programmed to shut off the current to said motor-fan assembly and said agitator drive motor for each position of said suction nozzle if the current drawn by said motor-fan assembly and said agitator drive motor exceeds a predetermined amount.

* * * * *